US006024766A

United States Patent [19]

Wasinger

[11] Patent Number: 6,024,766

[45] Date of Patent: Feb. 15, 2000

[54] PROCESS FOR ENZYMATIC DESIZING OF GARMENTS AND ENZYME DEACTIVATION

[76] Inventor: Eric M. Wasinger, 7977 Garden North Dr., San Antonio, Tex. 78266-1714

[21] Appl. No.: 09/240,783

[22] Filed: Jan. 27, 1999

[51] Int. Cl.[7] ..... D06L 3/02; D06L 3/04; D06L 3/08

[52] U.S. Cl. ..... 8/111; 8/101; 8/102; 8/109; 8/115.51; 8/115.7; 8/133; 8/137; 8/918; 8/401; 8/646

[58] Field of Search ..... 8/401, 646, 101–102, 8/107, 108.1, 109, 115.51, 115.7, 474, 918, 111, 137, 133

[56] References Cited

U.S. PATENT DOCUMENTS 5,261,925 11/1993 Wasinger et al. ..... 8/111
5,376,143 12/1994 Wasinger et al. ..... 8/111

*Primary Examiner*—Yogendra Gupta
*Assistant Examiner*—Brian P. Mruk
*Attorney, Agent, or Firm*—John Lezdey & Assoc

[57] ABSTRACT

There is provided a process of desizing textiles with enzymes together with a subsequent step of deactivating any residual enzymes to prevent degradation of the textiles. There is further provided a step or removal of any residual sizing and/or decolorizing dyed garments with ozone.

11 Claims, No Drawings

PROCESS FOR ENZYMATIC DESIZING OF GARMENTS AND ENZYME DEACTIVATION

FIELD OF THE INVENTION

This invention relates to a process for treating textiles, and more particularly, it relates to processes for desizing with enzymes and decolorizing woven fabrics based on denim fabrics or garments in a multi-stage operation.

DESCRIPTION OF THE PRIOR ART

There are four primary classes of enzymes:

1. Protease which removes protein soils such as blood, sebum, saliva, etc.;
2. Lipase is used to remove fatty soils and is commonly found in detergents;
3. Amylase is used to remove starchy material and is sometimes used in combination with proteases; and
4. Cellulase is used primarily in laundry detergents to form a basis for color safe laundry detergents.

Amylase is an enzyme commonly used in desizing textile materials. However, it is quite common that the enzyme fails to remove all of the sizing. Generally, about 10 to 30% of sizing remains on the garments because enzyme desizing is not sufficient to cause complete removal.

It is known that the preparation of denim fabrics made of cotton fibers or blends of cotton with other natural or synthetic fibers are woven from warp yarns that have been dyed usually with indigo dye (CI Vat Blue 1). The weft (crosswise or filling) yarns are typically undyed. The yarns are woven in such a way so as to place a high proportion of the colored (dyed) yarns on the face of the fabric. This is typically done by weaving the yarns using one of the twill weaves. The resulting fabric is known as blue denim.

Sizing is important in the fabric weaving process. In denim fabrics, the size is left in to give desirable properties to the denim garment so as to improve the wear properties of the fabrics or garments. However, if the garments are to be further processed for example subjected to a decolorization step to satisfy current fashion trends, it is necessary to first remove the remaining sizing. The desizing and removal of color of denim garments generally requires two separate operations wherein the sizing is first removed and then the garment is treated chemically or physically to decolorize or fade the blue color in the denim fabric. A typical enzymatic desizing preparation consists of an intimate mixture of a starch degrading enzyme such as amylase in an aqueous solution, preferably with a nonionic surfactant. Desizing is generally effected by impregnation of the denim fabric with an enzymatic solution at temperatures between 140° C. and 280° F. After a rinsing step, the fabric is prepared for further processing such as decolorization or stone washing to ultimately produce a fashion garment.

In the decolorization or fading step, some of the known processes cause substantial deterioration or degradation of the fabric. Abrading and chemical bleaching treatments or a combination of both methods tend to produce the desired faded result but these harsh conditions damage the fabrics which ultimately reduces the wear life of the garment. Enzyme presence further degrades the fabric when activated.

In an attempt to improve the decolorization or fading of fabrics, an ozone oxidation technique was developed. Ozone has been known to be used for bleaching of cellulose material without damaging the fibers as evidenced by U.S. Pat. Nos. 5,118,322, 5,261,925, 5,313,811 and 5,342,415, issued to Wasinger et al, all of which are incorporated herein by reference.

Despite the above subsequent vigorous operations, the impregnated enzymatic reagent in many cases remains within or on the surface of the fibers in a dormant and/or active state. The residual enzyme attacks the fibers of the fabric or garment if allowed to remain on the fabric or garment for any length of time. Furthermore, most enzymatic desizing operations are inefficient since about 30 percent of the sizing remains on the treated fabric. The residual enzyme and sizing interferes with an uniform decoloration step or results in a fabric not capable of use for medical purposes. Thus, it would be desirable to provide a fabric or garment substantially free of any active or dormant enzyme sites to improve wearability or residual sizing and to provide a more uniform decoloration of the fibers.

SUMMARY OF THE INVENTION

In accordance with the present invention, there is provided a process for treating fabrics or garments which have been sized only or sized and further contain oxidizable coloring agents such as a dye, pigment, and the like, which comprises the steps of:

1) treating with an effective amount of an enzyme to desize said fabric or garment, and
2) deactivating and/or making dormant substantially all of said enzyme with an ozone containing fluid.

Advantageously, the fabrics or garments are desized in an enzymatic bath at a temperature in the range of 140° to 170° F.

Optionally, the process may include the step of terminating the contact with said ozone containing fluid prior to substantial decolorization of the garment or fabric. Further, the process may include the step of decolorizing the garment or fabric with a bleaching agent.

It is, therefore, a general object of the invention to provide a means for desizing and decolorizing a fabric or garment in a multi-stage process which includes the step of permanently deactivating or killing any residual enzyme.

It is another object of the invention to enzymatically desize a fabric or garment more efficiently with substantially all of the enzyme reactant deactivated and dormant for the life of the fabric or garment.

It is a further object of the invention to prevent fiber damage from enzyme attack between processing steps or during storage.

It is still another object of the invention to prepare a fabric or garment for further treatment by the more efficient removal of a sizing agent.

It is yet another object of the invention to provide a process which evenly decolorizes or fades dyed garments to produce fashion garments which have been treated with enzymes.

DESCRIPTION OF THE PREFERRED EMBODIMENTS

According to the present invention, sized or sized and dyed fabrics and garments, which are enzymatically desized before undergoing subsequent processing, can be treated with ozone so as to remove the remaining sizing and deactivate and to make dormant any residual enzyme. This prevents any fiber degradation that might result from enzyme attack between processing steps or upon storage. Further, the substantial removal of any remaining sizing and residual enzyme reactant provides a more uniform decolorization or fading of the fabric or garment and improves other subsequent processes, such as printing. The process may be conducted either batchwise or continuous. When operated in the latter mode it is typically connected to subsequent conventional process steps such as decolorization or fading which are also operated continuously.

It should be understood that the term "dye" as used herein is meant to include any of the materials which are used to provide a color to a fabric or garment such as conventional dyes, pigments, or the like.

It should be understood that the term, "ozone containing fluid", is meant to include ozone per se or ozone in admixture with air, inert gases or aqueous systems.

In accordance with one embodiment of this invention, the enzyme deactivation step involves the dyed and sized fabrics or garments, which are placed into a washer/extractor and optionally equipped with a heating means such as steam coils or thermocouples and a source of ozone. Typically, the washer/extractor is a 500 gallon rotary drum type. A sufficient amount of an enzymatic preparation is utilized which consists of 10 to 40 parts of an aqueous amylase solution, for example, to which 10 to 60 parts of a non-ionic surfactant is added. The desizing step may be conducted at temperatures ranging between 60° and 250° F. and preferably between 140° and 170° F. The drum is preferably rotated at about 27–32 revolutions per minute. The desizing step with the enzyme is followed by successive rinses at 190–200° F., 140° F. and tap temperatures. After the final rinse, the water is extracted and an "ozone containing fluid" is injected into the system to deactivate and/or make dormant the residual enzyme and optionally to remove the remaining sizing on the fabric or garment. The rotation of the drum is resumed. Advantageously, the exposure to ozone may range from about 0.5 to 2 minutes. The concentration of the ozone is maintained at about 5 to 50 milligrams per liter and monitored with an ozone photometer. When substantially all the enzyme preparation is deactivated, and made dormant, the reaction is terminated preferably before any substantial decolorization of the fabric or garment.

Following the enzyme deactivation treatment, the fabric or garment is rinsed with unheated or tap water. After water extraction, an oxidizing agent can be added to the washer/extractor.

In a preferred decolorization step, an ozone containing fluid or a bleaching agent which is the preferred decolorizing or fading agent, is introduced into the washer/extractor after the deactivation of the enzyme. Typically, the ozone gas will be admixed with air so that an ozone concentration of about 10 to about 200 grams per cubic meter is obtained. Contact time of the fabrics or garments with the ozone containing fluid is dependant on the ozone concentration, the reactivity of the dye or colorant with the decolorizing agent and the amount of decolorizing agent on the fabric. Ozone initially attacks only the colorant in the fabric or garment and not the fibers themselves. Usually, the decolorizing with ozone can be conducted in less than about 1 hour, preferably less than 0.5 hour and most preferably from about 10 seconds to about 1 hour without any substantial degradation of the fabric.

During the decolorization or fading step, the decolorization agent is caused to contact the fabric, preferably while the fabric is tumbling in the chamber of the washer/extractor. As the fabric tumbles, the oxidizing agent reacts with the dyes or colorants in relation to the amount and the strength of treating agent on the fabric.

When ozone is utilized to deactivate or make dormant the enzyme, the ozone within the chamber is preferably measured periodically and kept at a minimal and within the range of about 10 to 200 grams per cubic meter. The ozone can be generated by an ozone generator of the type available from Griffin Technics, Inc. Model GTC-2B which produces ozone from dry air or oxygen using electrical circuit breakers or Corona discharge. The ozone may be used alone or diluted with oxygen or inert gases or in an aqueous systems. Removal of the oxidized dyes or colorants from the fabrics or garments after the decolorization step can be achieved by well known methods such as by washing the oxidized fabrics in hydrogen peroxide solutions and/or detergents.

If more extensive bleaching rather than just decoloration or fading is desired in the practice of the invention, various conventional bleaching agents may be used. Suitable oxidative bleachings agents include other oxidizing gases such as chlorine. For example, chlorine gas when added to water produces hypochlorous acid (HOCl). Under alkaline conditions alkaline hypochlorite is formed and equally useful. Sodium hypochlorite is generally used as a bleaching agent.

The garments may be colored (dyed) with one or more dyes. Utilizing dyes of differing degrees of reactivities provides the garment with zones of different appearances or effects. For example, faded, stone washed, ice-washed, sand blasted or mottled effects may be obtained.

The following examples are illustrative of the practice of the method of the present invention. It will be understood, however, that it is not to be construed in any way limitative of the full scope of the invention since various changes can be made without departing from the spirit of the teachings contained herein in light of the guiding principles which have been set forth above. All percentages stated herein are based on weight except wherein otherwise noted.

EXAMPLE 1

A. Desizing

Into a 500 gal. capacity rotary drum washer-extractor was placed 180 dyed denim jeans containing a starch sizing and 350 gal. of water at a temperature of 175° F. is added to the washer-extractor. The drum is rotated and 7.5 pounds of an enzymatic desizing composition composed of 30 parts of an aqueous amylase solution and 20 parts of a nonionic surfactant is added. The drum was rotated for about 20 minutes and the water was extracted. The garments were then rinsed twice with 220 gal. of cold water and spun to extract the water.

The resulting garments were all desized. Generally, about 10 to 30 percent sizing remains on the jeans based on the weight of the jeans after an enzyme desizing together with residual enzymes.

B. Decolorizing

The jeans which were removed from Part A were placed back into the washer/extractor and a mixture of:

An air-ozone mixture injected into the washer/extractor. The drum is rotated at about 30 rpm. The concentration of the ozone is maintained at about 20–40 milligrams per liter and monitored with an ozone photometer. Rotation was continued for about 10 minutes. After rinsing with tap water and extracting the water, a number of the denim jeans where pulled from the washer/extractor and when examined with a scanning atomic force microscope which did not reveal any signs of active enzyme sites and substantially no discoloration.

EXAMPLE 2

A. Preparation of Bleaching Solution

To 0.5 l of water is a container was added with stirring 60 g. of sodium hydroxide; 38 g. of formamidine sulfonic acid and 3 g. of sucrose.

B. Decolorizing 4 kg of desized denim jeans from Part A of Example 1 was placed into a washer/extractor 25 l of water heated to 75° C. was added and the jeans were tumbled so as to become uniformly wetted. The bleaching solution from Part A was added and tumbling continued for 0.5 hour. The liquid was drained and the jeans were rinsed with water and 2 g/l of acetic acid and 1 g/l of 35% hydrogen peroxide were added to the second rinse bath. The jeans are then tumbled for 0.5 hr., the liquid extracted and rinsed twice with water at 40° C. and then dried.

The jeans were lightened.

C. The jeans from Part B were tumbled in the washer/extracted while ozone/air was added so as to prevent yellowing during storage.

In lieu of formamidine sulfonic acid and sucrose, sodium hypochlorite may be utilized.

What is claimed is:

1. A process for treating fabrics or garments which have been sized and colored, which comprises the steps of:

1) treating with an effective amount of an enzyme to desize said fabric or garment;

2) deactivating and making dormant substantially all of said enzyme with an ozone containing fluid prior to any substantial decolorization of the fabrics or garments, wherein said deactivation with an ozone containing fluid is from about 30 seconds to 2 minutes and 3) decoloring said fabrics or garments with a bleaching agent which is free of ozone.

2. The process of claim 1 wherein said fluid of step 2) is selected from ozone gas, mixtures of ozone with air, inert gases or aqueous systems.

3. The process of claim 2 wherein said fluid is ozone gas.

4. The process of claim 2 wherein said fluid comprises air and ozone.

5. The process of claim 2 wherein said fluid of step 2) comprises ozone and an aqueous system selected from steam or an aqueous solution.

6. The process of claim 1 wherein said bleaching agent is alkali hypochlorite.

7. A fabric or garment treated by the method of claim 1.

8. The fabric or garment of claim 7 made of denim.

9. The garment of claim 7 selected from shirts, hats, jeans, jackets and vests.

10. A method for treating fabrics or garments which have been sized and dyed with an oxidizable dye which comprises the steps of:

1) treating with an effective amount of enzyme to desize said fabric or garment;

2) deactivating substantially all of said enzyme with an ozone containing fluid, wherein said deactivation with an ozone containing fluid is from about 30 seconds to 2 minutes;

3) terminating the contact with said fluid mixture prior to any substantial decolorization of the fabric or garment and 4) decolorizing said fabric or garment with an ozone free oxidizing agent.

11. The process of claim 10 wherein said oxidizing agent is a hypochlorite compound.

* * * * *